US011361707B2

(12) United States Patent
Collot et al.

(10) Patent No.: US 11,361,707 B2
(45) Date of Patent: Jun. 14, 2022

(54) PASSIVE LED MATRIX DISPLAY DRIVER WITH HIGH DYNAMIC RANGE

(71) Applicant: DeepSky Corporation Limited, Hong Kong (CN)

(72) Inventors: Laurent Collot, Hong Kong (CN); Wai Kin Cheng, Hong Kong (CN)

(73) Assignee: DEEPSKY CORPORATION LIMITED, Hong Kong (HK)

( * ) Notice: Subject to any disclaimer, the term of this patent is extended or adjusted under 35 U.S.C. 154(b) by 0 days.

(21) Appl. No.: 17/250,750

(22) PCT Filed: Sep. 3, 2018

(86) PCT No.: PCT/EP2018/073580
§ 371 (c)(1),
(2) Date: Mar. 1, 2021

(87) PCT Pub. No.: WO2020/048578
PCT Pub. Date: Mar. 12, 2020

(65) Prior Publication Data
US 2021/0350741 A1 Nov. 11, 2021

(51) Int. Cl.
*G09G 3/32* (2016.01)

(52) U.S. Cl.
CPC ..... *G09G 3/32* (2013.01); *G09G 2300/06* (2013.01)

(58) Field of Classification Search
CPC ..... G09G 3/32
USPC ..... 345/691
See application file for complete search history.

(56) References Cited

U.S. PATENT DOCUMENTS

2004/0257386 A1* 12/2004 Sagano ..... G09G 3/22 345/690
2007/0247065 A1* 10/2007 Ko ..... H01L 27/3288 313/505
2010/0289779 A1* 11/2010 Routley ..... G09G 3/3266 345/205

* cited by examiner

*Primary Examiner* — Long D Pham
(74) *Attorney, Agent, or Firm* — Nevin Stuart; Carmichael

(57) ABSTRACT

A display driver has current reference units and current-generating units. Each current reference unit generates a reference current and scaling it to form a scaled reference current. Each current-generating unit generates an output current from one scaled reference current to drive a selected light emitter (LE) of a LE matrix over a time slice allocated for driving the selected LE. Each current-generating unit has a switching circuit modulating the scaled reference current according to a switching sequence to form output current pulses to drive a LE. The processor determines the switching sequence to avoid a shortest current pulse shorter than a minimum current pulse width via (a) calculating a duty cycle as a ratio of an average output current to the scaled reference current, (b) mapping the duty cycle to a modulation sequence, and (c) repeating stretching a time duration of the modulation sequence by double, splitting the modulation sequence into half, and allocating the split sequence into two times of original time slice, until the shortest current pulse satisfies the above-mentioned requirement.

20 Claims, 5 Drawing Sheets

PASSIVE LED MATRIX DISPLAY DRIVER WITH HIGH DYNAMIC RANGE

FIELD OF THE INVENTION

The present disclosure relates to a display driver for driving a passive matrix of light emitters (LEs).

BACKGROUND

A plurality of LEs has a lot of applications, mainly but not limited to visual display. A LE can be any light emitting structure with a diode characteristic that emits light when an electrical current goes through, which can be an inorganic light emitting diode (LED), an organic LED, or a thermal emitter. LEs can be connected together as a rectangular array such that each LE is addressed by a row number and a column number, which can be referred to as a matrix. When there is any active component such as a transistor or an amplifier inside the interconnect network of the matrix, the matrix is referred to as an active matrix. In contrast, when there is no any active component inside the interconnect network of the matrix, the matrix is referred to as a passive matrix. A passive matrix can be divided into a plurality of panel subsections each being a row or a column of LE. Panel subsections are one-by-one powered to emit light in a round-robin manner. Each subsection is allocated with a time slice within which a current is supplied to the LE to thereby light up the LE, which can be referred to as time-multiplexing. The LE is commonly driven by a constant current, which can be switched ON or OFF sequentially by a control circuit. The light intensity of LE as perceived by a person can be controlled by the ratio of the ON duration to the sum of the ON and OFF durations. Some common examples of LE switching schemes are pulse width modulation (PWM) and pulse frequency modulation (PFM). The light intensity is seldom controlled by directly adjusting the current because it is more difficult or expensive to design a high-resolution current digital-to-analog converter (DAC), and that the emission wavelength of LE usually changes with the actual current going through it. The shift of emission wavelength is known for LEDs. This shift of emission wavelength is undesirable for a display.

A passive matrix of LEs can be driven by an integrated circuit which generates a constant current for each LE in a panel subsection. In the display driver, a plurality of current sources is implemented. Each current source is used for driving pixels in a respective subsection of the display panel. By turning ON and OFF of a MOSFET switch connected to the end of each subsection, subsections are driven one-by-one in a time-multiplexing manner. The time taken to completely drive all subsections is referred to as a frame or a frame period, and the reciprocal of frame period is referred to as a frame rate. The individual current source provides a current of ON-OFF type according to a switching sequence. The switching sequence, although practically implemented in the digital domain as a discrete-time sequence for controlling the individual current source to switch ON or OFF, is by nature a switching waveform in time.

With an ever increasing demand for a better image-reproduction quality, there is a need for a display driver to provide a higher frame rate and a higher dynamic range of luminance levels, i.e. a finer step in the luminance level. Having a higher frame rate reduces the length of the time slice. Having a finer step in the luminance level implies that the output current appears as a current pulse with a decreasing width. For example, if the pixel has a 12-bit resolution and if a full current pulse is used to drive the LED to produce the highest luminance for the pixel (corresponding to an image data value of 4095), the narrowest pulse (occurred for an image data value of 1) is 1/4096 of the full current pulse in width. If the resolution is increased to 16 bits, the narrowest pulse has an even smaller width that is 1/65536 of the full current pulse.

Generation of such a narrow pulse is limited by several factors, including a frequency response of the control circuit, an electrical loading of the passive-matrix display panel, and the response time of LE. A system failing to deliver a correct ON duration leads to non-linearity in light intensity, especially at a low-light condition, resulting in an unpleasant visual effect. It is desirable to avoid using narrow pulses in driving the LE matrix.

Targeted to large LED panels, CN102768820 discloses a display driver having a high-current driver as one constituent component and a low-current driver as another. In driving a large LED screen by using multiple display drivers, an individual display driver determines whether the high- or low-current driver is used according to whether the region of image contains bright details or dim details. However, the display driver of CN102768820 may not be able to avoid using narrow pulses if the region of image under consideration has both bright and dim details.

There is a need in the art for a display driver that avoids narrow current pulses while delivering a high dynamic range of luminance and a high frame rate in driving a LE matrix. The display driver is especially useful for driving a large LED screen.

SUMMARY OF THE INVENTION

An aspect of the present disclosure is to provide a display driver for driving a LE matrix with a goal of delivering a high dynamic range of luminance and a high frame rate while avoiding narrow current pulses in driving the LE matrix. The LE matrix comprises plural LEs.

The display driver comprises one or more current reference units, a plurality of current-generating units, and a processor. An individual current reference unit is used for generating a reference current and scaling the reference current with an amplitude-scaling factor to form a scaled reference current. Generally, the individual current reference unit comprises a constant current source for generating the reference current, and a current-scaling circuit for scaling the reference current with the amplitude-scaling factor to form the scaled reference current. An individual current-generating unit is arranged to receive one copy of a scaled reference current and is used for generating an output current from the received scaled reference current to drive a selected LE of the passive matrix over a time slice allocated for driving the selected LE. A time average of the output current over the time slice is proportional to a required luminance level to be generated by the selected LE (according to an appropriate image data). The current-generating unit comprises a switching circuit. The switching circuit is used for modulating the scaled reference current according to a switching sequence to form the output current pulses to drive a LE. The display driver further comprises a processor configured to control the current-scaling circuit and the switching circuit by at least determining the switching sequence, or also the amplitude-scaling factor.

In one embodiment, the processor is configured to determine the switching sequence and the amplitude-scaling factor. The amplitude-scaling factor is determined such that the scaled reference current is larger than the maximum desired output current of all LEs in the matrix. The full switching sequence is first determined by multiplying the amplitude-scaling factor to a digital value which represents a desired brightness of each LE. According to a predefined maximum frame period, the processor splits the switching sequence into a plurality of equal portions. Portions of switching sequence are applied to each LE in each subsection for a plurality of consecutive frames, such that for each LE, over the time duration of these consecutive frame. The switching sequence appears to be the same as the full switching sequence. The required luminance level of each LE is preserved, while narrow current pulses are avoided in driving each LE.

In another embodiment, the processor is configured to only determine the switching sequence. The amplitude-scaling factor is pre-calculated by an external processor. The digital value which represents the desired brightness of each LE is also pre-calculated by the external processor according to the amplitude-scaling factor. The amplitude-scaling factor and the processed digital value are sent to the display driver. The processed digital value further goes to the processor inside the display driver to perform the same split processing of switching sequence described in the first embodiment.

The display driver may use a current source to generate the reference current, and one or more current mirrors to duplicate the reference current into plural copies thereof. Preferably, the current source is implemented as a switched-capacitor current reference circuit for its advantage of having a low temperature sensitivity.

It is also preferable that the current-scaling circuit is a variable-gain current mirror responsive to the amplitude-scaling factor determined by the processor.

The display driver may further include a subsection-selector circuit configured such that when the LE matrix is arranged as a rectangular array of LEs and the LEs in the array are addressed by row lines and column lines of the passive matrix, the subsection-selector circuit selects, through the row lines or the column lines, the selected LE to receive the output current.

Other aspects of the present invention are disclosed as illustrated by the embodiments hereinafter.

DETAILED DESCRIPTION

An aspect of the present disclosure is to provide a display driver for driving a passive LE matrix with a goal of delivering high dynamic range of luminance and high frame rate while avoiding using narrow pulses in driving the LE.

Figure 1:
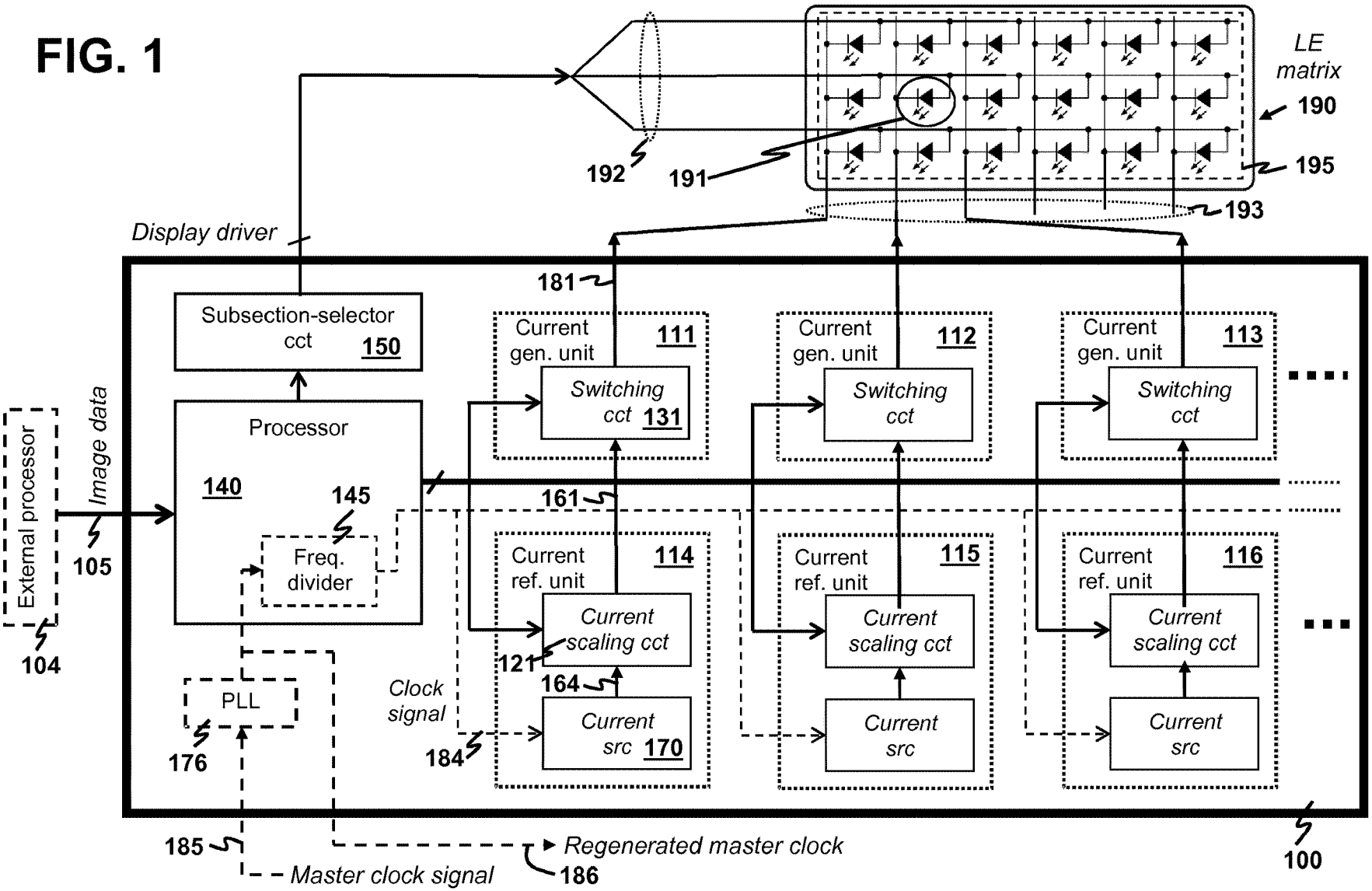
FIG. 1 depicts an exemplary display driver for driving a LE matrix.

Exemplarily, the display driver is illustrated hereinafter with an aid of FIG. 1, which depicts an exemplary display driver 100 for driving a LE matrix 190. The LE matrix 190 as considered in illustrating the present invention comprises plural LEs 195. As one practical choice, each of the LEs includes one or more LEDs for light generation. For illustration of the display driver 100 hereinafter without loss of generality, the LE matrix 190 is divided into plural panel subsections each of which is a row such that the display driver 100 drives the rows one-by-one in a time-multiplexing manner.

In the display driver 100, a reference current is used to generate various output currents to drive the LE matrix 190.

The display driver 100 comprises one or more current reference units (hereinafter represented by current reference units 114-116 in FIG. 1) all of which are substantially-similar in structure or structurally the same. In the case that there is only one current reference unit (not shown in FIG. 1 for simplicity), the scaled reference current is shared among different colors or types of LEs. In the case that there are more-than-one current reference units 114-116, each color or type of LE has its own scaled reference current. Without loss of generality, consider the current reference unit 114 as a representative current-generating unit in illustrating the present invention. The current reference unit 114 comprises a current source 170 and a current-scaling unit 121. The current source 170 is also commonly known as a constant current source. In the art, techniques for designing the constant current source and a current mirror are abundant, e.g., U.S. Pat. No. 6,087,820 for the constant current source and U.S. Pat. No. 7,429,854 for the current mirror. The current-scaling circuit 121 is used to scale its received copy of reference current 164 with an amplitude-scaling factor to form a scaled reference current 161. The current-scaling circuit 121 is implemented as a variable-gain current amplifier.

Preferably, the current source 170 is implemented as a switched-capacitor current reference circuit for its advantage of having a low temperature sensitivity. In this implementation, the current source 170 comprises a capacitor and a switching arrangement used for alternately charging and discharging the capacitor at a rate according to a frequency of a clock signal 184 received by the current source 170 in order to generate the reference current such that the reference current is controllable by the frequency of the clock signal 184. Details of the switched-capacitor current reference circuit can be found in the art, e.g., in U.S. Pat. No. 6,784,725. Practically, the processor 140 is configured to provide the clock signal 184 to the current source 170. Usually, the processor 140 generates the clock signal 184 by scaling down a master clock signal 185. The processor 140 may include a programmable frequency synthesizer circuit 145 for scaling down the frequency of the master clock signal 185.

Normally, the master clock signal 185 is further used as a system clock to provide a timing reference in data transmission between the display driver 100 and elsewhere, e.g., in receiving image data 105 by the processor 140. The display driver 100 may further include a phase locked loop (PLL) 176 to construct a clean, regenerated master clock 186 from the master clock signal 185. The regenerated master clock 186 is usable for the display driver 100 internally. In case the LE matrix 190 is a large LE display screen driven by multiple display drivers, the regenerated master clock 186 may be advantageously distributed to other display drivers for master clock synchronization.

Figure 3:
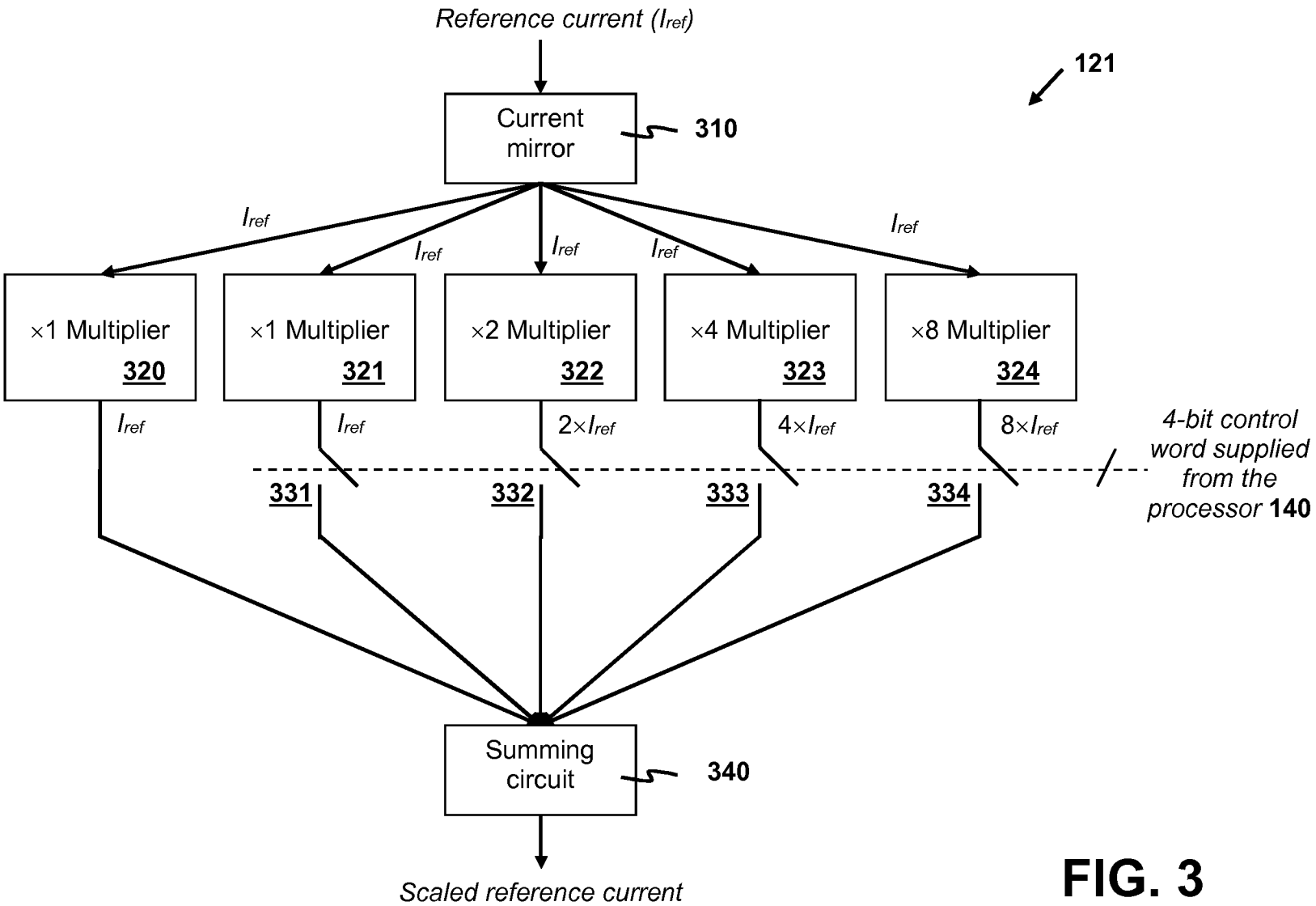
FIG. 3 depicts one implementation of the current-scaling circuit as a variable-gain current mirror.

FIG. 3 depicts one implementation of the current-scaling circuit 121 as a variable-gain current mirror responsive to the amplitude-scaling factor determined by the processor 140. The received copy of reference current 164, denoted as $I_{ref}$ in FIG. 3, is first duplicated into five copies by a current mirror 310. The five copies are respectively received by five multipliers 320-324. The multipliers 320, 321 are unity-gain multipliers. Although the multipliers 320, 321 are shown in FIG. 3, each of these multipliers is usually implemented by simply passing the reference-current copy to its multiplier output. The multipliers 322, 323, 324 are ×2, ×4 and ×8 multipliers, respectively. Those skilled in the art will appreciate that each of the multipliers 322-324 can be realized as a current mirror with gain. Switches 331-334 are used to control which amplified currents from the multipliers 321-324 are summed in a summing circuit 340. The summing circuit 340 also includes the output of the unity-gain multiplier 320 in the summation. The processor 140 digitally controls on and off states of the four switches 331-334 through a 4-bit control word. The output of the summing circuit 340 is the scaled reference current 161. The 4-bit control word configures the current-scaling circuit 121 to provide an overall current gain given by the amplitude-scaling factor. Those skilled in the art can show that the scaled reference current 161 is selected from 1 to 16 times of the received copy of reference current 164, indicating that possible values of the amplitude-scaling factor are positive integers from 1 to 16. Although 16 levels of the scaled reference current 161 are provided by the variable-gain current mirror of FIG. 3 as an example for illustration, those skilled in the art will appreciate that increasing or decreasing the number of multipliers in the variable-gain current mirror can change the number of levels that can be provided. Those skilled in the art will also appreciate that adjusting the ratio of multipliers can create levels in exponential scale instead of linear scale.

Other realizations of the current-scaling circuit 121 are possible, e.g., the programmable gain current amplifier disclosed in U.S. Pat. No. 7,088,180.

In one option, the current-scaling circuit 121 scales up the received copy of reference current 164 to form the scaled reference current 161 so that the amplitude-scaling factor is greater than or equal to unity. In an alternative option, the current-scaling circuit 121 scales down the received copy of reference current 164 to form the scaled reference current 161 so that the amplitude-scaling factor is less than or equal to unity. Those skilled in the art may determine which option to be adopted by consideration of practical factors in implementation of the display driver 100. Nevertheless, since the received copy of reference current 164 continuously flows at least during the entire time slice, a larger reference current potentially results in a higher power consumption. The option of scaling up the received copy of reference current 164 by the current-scaling circuit 121 is usually preferable over the option of scaling down.

The display driver 100 further comprises a plurality of current-generating units (hereinafter represented as current-generating units 111-113) all of which are substantially-similar in structure or structurally the same. Without loss of generality, consider the current-generating unit 111 as a representative current-generating unit in illustrating the present invention. The current-generating unit 111 is used for generating an output current 181 to drive a certain selected LE 191 of the passive matrix 190. In addition, the current-generating unit 111 is arranged to receive the scaled reference current 161 such that the output current 181 is generated from the received scaled reference current 161. Furthermore, the current-generating unit 111 is used for generating the output current 181 over a predetermined duration allocated for driving the selected LE 191, i.e. a time slice as mentioned above.

The current-generating unit 111 comprises a switching circuit 131 for modulating the scaled reference current 161 according to a switching sequence determined by the processor 140 to form the output current 181. The output current 181 is therefore a sequence of current pulses. The current-generating unit 111 is configured such that a time average of the output current 181 over the time slice is proportional to a required luminance level to be generated by the selected LE 191 (according to an appropriate image data).

The display driver 100 further comprises a processor 140 configured to control the current-scaling circuit 121 and the switching circuit 131. In one embodiment, the amplitude-scaling factor and switching sequence are determined by the processor 140. In another embodiment, only the switching sequence is determined by the processor 140; an external processor 104 may be used to determine the amplitude-scaling factor.

An inventive feature of the present invention is in the determination of the amplitude-scaling factor and the switching sequence for avoiding the pulse of the output current 181 being overly narrow.

The determination of amplitude-scaling factor and the switching sequence is exemplarily illustrated by reference to FIG. 2, which depicts as an example an output current 210 of an individual current-generating unit (selected from the plurality of current-generating units 111-113). The individual current-generating unit is intended to generate the output current 210 to yield a certain desired value of an average output current 200, where the average output current 200 is a time average of the output current 210 over a plurality of time durations 220 allocated for driving a LE (viz., time slices). As mentioned above, the desired value is determined according to an appropriate image data. The output current 210 of one LE is obtained by using a switching circuit to modulate a scaled reference current 212 generated from a current-scaling circuit according to a switching sequence determined by the processor 140. The switching circuit allows the scaled reference current 212 to drive the LE over a certain switch-on time 213 within one time slice 220, and to stop driving the LE over the remaining part of one time slice 220. A plurality of switching circuits drives the first subsection of LEs in the same time slice according to the respective image data of each LE. This time slice can be referred to as the first time slice for the first subsection of LEs. The switching circuits then drive the second subsection of LEs in the next time slice, which can be referred to as the first time slice for the second subsection of LEs. This continues until all LEs are driven for the first time slice. Then, the switching circuits drive the first subsection of LEs again, which can be referred to as the second time slice for the first subsection of LEs. This continues until all subsections of LEs are driven for a finite number of time slices, which can be predefined or calculated by the processor 140 as described later. The ratio of the sum of switch-on times 213 of one LE to the sum of time slices 220 is the duty cycle for that particular LE.

Figure 2:
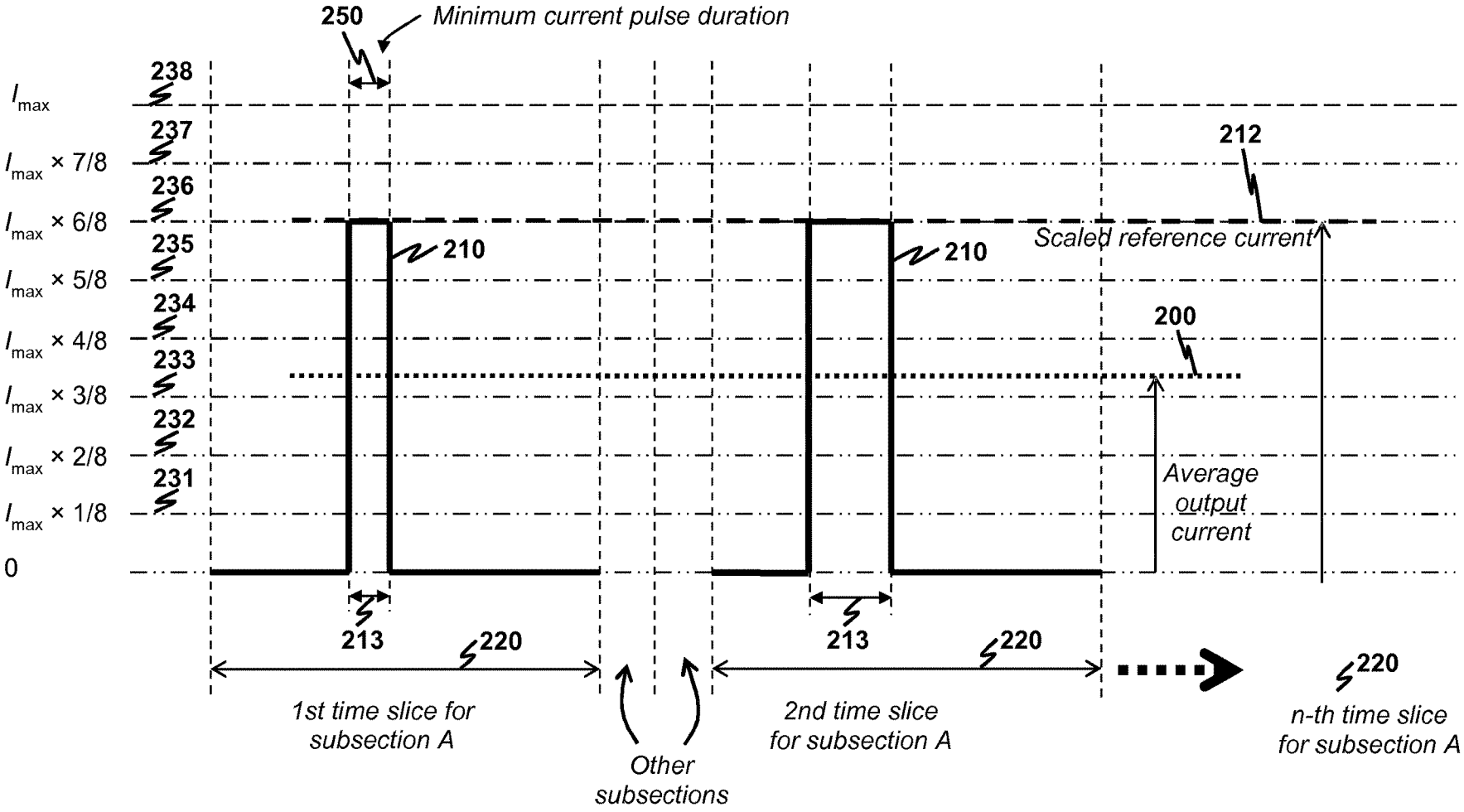
FIG. 2 depicts an output current of an individual current-generating unit as an example for illustrating the determination of amplitude-scaling factor used in a current-scaling circuit of the individual current-generating unit in scaling the reference current.

To explain the determination of the amplitude-scaling factor, consider an example that the amplitude-scaling factor of the current-scaling circuit is an integer selected from 1 to 8, so that there are eight permissible levels of scaled reference current to form a set of eight scaled-current candidates 231-238 as depicted in FIG. 2. The highest scaled-current candidate ($I_{max}$) 238 is set to be the maximum allowable output current because when the duty cycle is 100%, a resultant average output current for driving the LE is the maximum allowable output current. It follows that the reference current is ⅛ of the highest scaled-current candidate 238. The reference current is also the lowest scaled-current candidate 231, which is also referred to as the first scaled-current candidate 231 for convenience. Also for convenience, the remaining seven scaled-current candidates 232-238 are sequentially numbered when referencing them. The desired value of the average output current 200 is between the third scaled-current candidate 233 and the fourth one 234.

Figure 5:
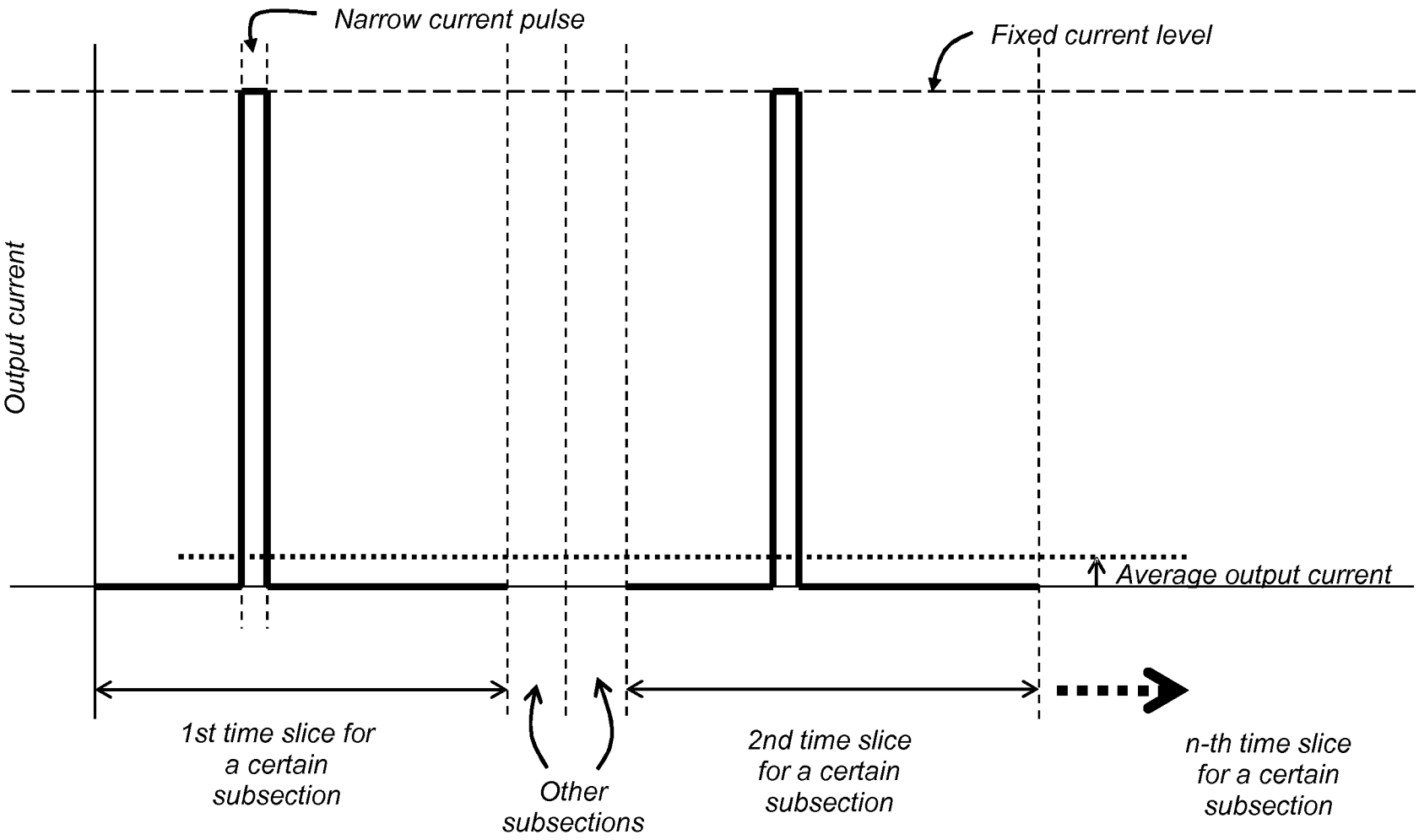
FIG. 5 (Prior Art)
FIG. 5 is a plot of current and time for showing that if a fixed reference current is used, and if an average current level desired to be generated is low, an overly narrow current pulse may occur.

If, instead of selecting the fourth scaled-current candidate 234 as the scaled reference current 212, one selects the maximum allowable output current 238 as the scaled reference current, a resultant pulse must have a width shorter than the switch-on time 213. (See FIG. 5.) Hence, selecting the maximum allowable output current 238 as the scaled reference current should be avoided whenever possible. After generalization, a rule for the processor 140 to advantageously adopt is stated as follows.

Rule A-1: In determining the amplitude-scaling factor, selecting a first amplitude-scaling factor that causes the scaled reference current to be strictly less than the maximum allowable output current as the amplitude-scaling factor is prioritized over selecting a second amplitude-scaling factor that causes the scaled reference current to be the maximum allowable output current as the amplitude-scaling factor.

A further optimization to Rule A-1 is given as follows. Similar to the above-mentioned observation, if one selects any of the fifth, sixth and seventh scaled-current candidates 235-237, a resultant pulse must have a width shorter than the switch-on time 213. It is undesirable. If, on the other hand, one selects any of the third, second and first scaled-current candidates 233, 232, 231, achieving the same desired value of the average output current 200 would require a pulse that has a width exceeding the time slice 220 allocated for driving the LE. It is impractical. Therefore, the best choice of the scaled reference current is the fourth scaled-current candidate 234. Note that while all the fourth to eighth scaled-current candidates 234-238 are upper bounds of the desired value of the average output current 200, the fourth scaled-current candidate 234 is a least upper bound of the desired value. After generalization, a second rule for the processor 140 to advantageously adopt is given as follows. The amplitude-scaling factor is determined via determining a scaled reference current according to the desired value of average output current under a constraint that the scaled reference current is selected from a finite set of scaled-current candidates. The scaled reference current is determined to be a least upper bound of the desired value among the scaled-current candidates in the set.

Rule A-1, which is mainly focused on driving a single LE, is extendable for the case of driving LEs in one subsection of the matrix, as follows.

Rule A-2: Knowing that the scaled reference current 161 is shared among a plurality of current-generating units 111-113, Rule A-1 must be fulfilled for all current-generating units generating the output current 200 for all LEs in the current subsection of passive matrix 190. Therefore, the scaled reference current 212 must be selected as the highest candidate fulfilling Rule A-1 for all LEs in the current subsection of passive matrix 190.

After determination of amplitude-scaling factor is completed, the processor 140 further determines the switching sequence. According to Rule A-1 and Rule A-2, the scaled reference current 212 must be larger than the required average current of all LEs over the time slices 220. Therefore, the required average current of all LEs can be generated by switching ON and OFF at an appropriate ratio of time period for each LE. The specific ON and OFF switching over time slices 220 is referred to as the switching sequence. The duty ratio of the switching sequence for each LE is determined by the ratio of desired value of average output current 200 to the scaled reference current 212 as determined by Rule A-1 and Rule A-2. One should notice that the duty cycle required in the present invention is larger than those with a fixed output current because of the scaled reference current. A larger duty cycle leads to larger current pulses. The duty cycle is mapped to a modulation sequence, which can PWM, PFM or any possible sequences consists of ON and OFF states. Without loss of generality, the current invention can process with any kind of modulation sequences. To further avoid a current pulse that is too narrow to drive, define a minimum current pulse width 250. The processor 140 optimizes the switching sequence of the following rules:

Rule B-1: For each LE, if the required duty cycle yields narrow pulses shorter than the minimum current pulse width 250, stretch by double the time duration of total modulation sequence, split the stretched modulation sequence into 2, and allocate the split modulation sequences in the first and second time slices. By stretching the time duration of switching sequence, the narrow pulses are extended in time by a double. If the narrow pulses are still shorter than the minimum current pulse with 250, further stretch the time duration of modulation sequence by another double, split the stretched modulation sequence and allocate the split modulation sequences in the first, second, third, and fourth time slices. Repeat the procedure until all narrow pulses are wider than the minimum current pulse width 250.

Rule B-2: Knowing that a time slice 220 is shared among all LEs in the same subsection, Rule B-1 must be fulfilled for all switching sequences of all LEs in the same subsection. Take the largest number of split obtained in Rule B-1, and split the same number of times for all switching sequences of all LEs in the same subsection.

Rule B-3: An alternative to Rule B-1 and Rule-B2 is to pre-define a number of splits such that any switching sequence must fulfill the minimum current pulse width 250.

Those skilled in the art will realize the fact that the actual luminance of LE is affected by the quantum efficiency of each LE, which can also be referred to as non-linearity of LE. Such non-linearity may differ in different LEs, leading to non-uniform luminance of the display which is unpleasant to the viewer or undesirable for the application.

In the second embodiment of the present invention, the determination of amplitude-scaling factor and the required duty cycle is performed by an external processor 140. The determination of the switching sequence remains on processor 140 as described in the first embodiment. A calibration procedure may be carried out to compensate for the non-linearity of each LE. Calibration data obtained can be stored in a database. The external processor 140 can make use of the database and perform a better determination of amplitude-scaling factor and required duty cycle such that the final luminance of each LE in the passive matrix 190 is uniform. The pre-determined amplitude-scaling factor and required duty cycle are directly sent to the processor 140, which further determines the switching sequence by Rule B-1 and Rule B-2 or Rules B-3 to avoid narrow current pulses.

Other implementation aspects of the display driver 100 are elaborated as follows.

Figure 4:
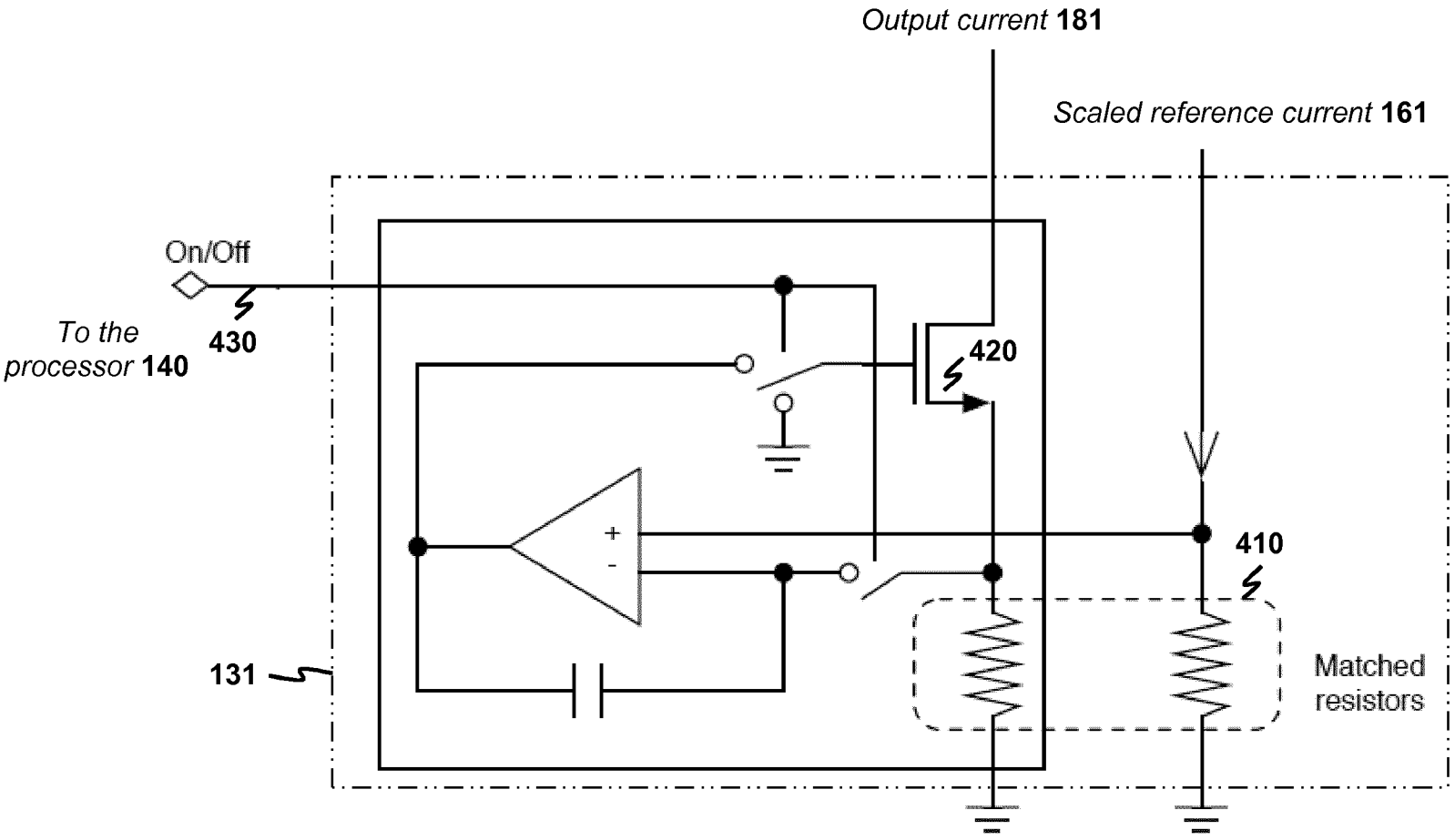
FIG. 4 depicts one implementation of a switching circuit of the individual current-generating unit.

FIG. 4 depicts one implementation of the switching circuit 131. The switching circuit 131 has a matched-resistor pair 410 acting as a current mirror to duplicate the scaled reference current 161. A MOSFET 420 is used as a switch to control passage of the duplicated scaled reference current in forming the first output current 181. The ON and OFF states of the MOSFET 420 are digitally controlled by the processor 140 through a one-bit on/off signal 430.

In most practical forms of the LE matrix 190 (e.g., a LED passive matrix), the LE matrix 190 is arranged as a rectangular array of LEs and the LEs in the array are addressed by row lines 192 and column lines 193 of the LE matrix 190. Preferably, the display driver 100 further includes a row-selector circuit 150 configured to address, through the row lines 192, the selected LEs 191 to receive the output current 181.

Although the rectangular array of LEs is used to illustrate the display driver disclosed herein, the disclosed display driver is not limited to being used for the LE matrix 190 that is arranged as the rectangular array. The display driver disclosed herein is also applicable to the LE matrix 190 that is a non-rectangular arrangement of LEs, e.g., a spherical LED display screen as considered in CN102915680.

In most situations, the LE matrix 190 is a LED matrix and is used to display color images such that the LEDs 195 of the LE matrix 190 are partitioned into red LEDs, green LEDs and blue LEDs. A pixel of the LE matrix 190 is formed by co-locating one red LED, one green LED and one blue LED in the LE matrix 190. To drive the LE matrix 190, the plurality of current-generating units 110 is organized such that groups of three current-generating units (e.g., 111-113) are formed and such that the aforesaid three current-generating units in each group are used for respectively and simultaneously driving the co-located red, green and blue LEDs of the pixel.

The display driver 100 may be implemented in various practical forms. In one form, the display driver 100 is realized as an IC or an application specific integrated circuit (ASIC). The processor 140 and the row selector circuit 150 in the display driver 100 are digital circuits and may be implemented as hardwired digital logics, by field programmable gate arrays (FPGAs), or by other programmable logic devices. The processor 140 may also be implemented using a general purpose or specialized computing device, or a computer processor.

Although the display driver 100 is particularly useful to driving a large LED display panel as mentioned above, the display driver 100 is also useful to driving LED displays of other sizes. The display driver 100 may be used in an image display system such as an outdoor LED display panel, a pure-LED television and a LED-based computer monitor. Such image display system integrates a LED display panel and one or more display driver ICs together. The one or more display driver ICs are collectively used to drive the LED display panel. Each display driver IC is configured according to any of the embodiments of the disclosed display driver. When more-than-one display driver ICs are used in the image display system, an individual display driver IC is arranged to drive a LE matrix that forms a part of the LED display panel.

The present invention may be embodied in other specific forms without departing from the spirit or essential characteristics thereof. The present embodiment is therefore to be considered in all respects as illustrative and not restrictive. The scope of the invention is indicated by the appended claims rather than by the foregoing description, and all changes that come within the meaning and range of equivalency of the claims are therefore intended to be embraced therein.

What is claimed is:

1. A display driver for driving a matrix of light emitters (LEs), the display driver comprising:

one or more current reference units, an individual current reference unit being used for generating a reference current and scaling the reference current with an amplitude-scaling factor to form a scaled reference current;

a plurality of current-generating units, an individual current-generating unit being arranged to receive one copy of the scaled reference current from one current reference unit, and being used for generating an output current from the received copy of scaled reference current to drive a selected LE of the LE matrix over a plurality of time slices allocated for driving the selected LE, a time average of the output current over the plurality of time slices being directly proportional to a required luminance level to be generated by the selected LE, wherein the individual current-generating unit comprises a switching circuit for modulating the scaled reference current according to a switching sequence; and a processor configured to receive a pre-calculated amplitude-scaling factor and a pre-calculated duty cycle from an external processor, and to control the switching circuit by determining the switching sequence that meets a requirement of minimum current pulse width, wherein the switching sequence is determined via (a) mapping the duty cycle to a modulation sequence, and (b) repeating a process of stretching a time duration of the modulation sequence by double, splitting the modulation sequence into half, and allocating the split sequence into two times of original time slices, until a shortest current pulse in the modulation sequence is wider than or equal to the required minimum current pulse width.

2. The display driver of claim 1, wherein the processor is configured to receive the amplitude-scaling factor of each subsection of LEs in a same row or column of the LE matrix.

3. The display driver of claim 1, wherein the processor is configured to determine the switching sequence via repeating the stretching, splitting and allocating process for a predetermined number of iterations wherein the shortest current pulse in the resulting switching sequence is wider than or equal to the minimum current pulse width.

4. The display driver of claim 1, wherein the individual current reference unit comprises:

a constant current source for generating the reference current; and a current-scaling circuit for scaling the reference current with the amplitude-scaling factor to form the scaled reference current.

5. The display driver of claim 4, wherein the current source is implemented as a switched-capacitor current reference circuit.

6. The display driver of claim 5, wherein the processor is further configured to provide a clock signal to the current source.

7. The display driver of claim 6, wherein the processor is further configured to generate the clock signal from a master clock signal receivable at the processor by scaling down a frequency of the master clock signal.

8. The display driver of claim 7, wherein the processor includes a programmable frequency synthesizer circuit for scaling down the frequency of the master clock signal.

9. The display driver of claim 4, wherein the current-scaling circuit is a variable-gain current mirror responsive to the amplitude-scaling factor determined by the processor.

10. The display driver of claim 4, wherein the current-scaling circuit scales up or down the received copy of reference current with the amplitude-scaling factor to form the scaled current.

11. The display driver of claim 1, further comprising:

a subsection-selector circuit configured such that when the LE matrix is arranged as a rectangular array of LEs and the LEs in the LE matrix are addressed by row lines and column lines of the LE matrix, the subsection-selector circuit selects, through the row lines or the column lines, the selected LE to receive the output current.

12. The display driver of claim 1, wherein the plurality of current-generating units is arranged such that groups of three current-generating units are formed, said three current-generating units in each group being used for respectively and simultaneously driving a red LED light source, a green LED light source and a blue LED light source of one pixel in the LE matrix.

13. An image display system comprising:

a light emitting diode (LED) display panel; and a plurality of display driver integrated circuits (ICs) for driving the LED display panel, wherein an individual display driver IC is arranged to drive a LE matrix that forms a part of the LED display panel, and is configured to be the display driver of claim 1.

14. A display driver for driving a matrix of light emitters (LEs), the display driver comprising:

one or more current reference units, an individual current reference unit being used for generating a reference current and scaling the reference current with an amplitude-scaling factor to form a scaled reference current;

a plurality of current-generating units, an individual current-generating unit being arranged to receive one copy of the scaled reference current from one current reference unit, and being used for generating an output current from the received copy of scaled reference current to drive a selected LE of the LE matrix over a plurality of time slices allocated for driving the selected LE, a time average of the output current over the plurality of time slices being directly proportional to a required luminance level to be generated by the selected LE, wherein the individual current-generating unit comprises a switching circuit for modulating the scaled reference current according to a switching sequence; and a processor configured to control the current-scaling circuit and the switching circuit by determining the amplitude-scaling factor and the switching sequence, the switching sequence being determined to meet a requirement of minimum current pulse width, wherein:

the amplitude-scaling factor is determined via determining the scaled reference current according to a desired value of the average output current under a constraint that the scaled reference current is selected from a finite set of scaled-current candidates, the average output current being computed as the time average of the output current over the plurality of time slices, a maximum among the scaled-current candidates in the set being selected as the maximum allowable output current, the scaled reference current being determined such that the scaled reference current is a least upper bound of the desired value among the scaled-current candidates in the set; and the switching sequence is determined via (a) calculating a duty cycle as a ratio of the desired value of average output current to the scaled reference current, (b) mapping the duty cycle to a modulation sequence, and (c) repeating a process of stretching a time duration of the modulation sequence by double, splitting the modulation sequence into half, and allocating the split sequence into two times of original time slices, until a shortest current pulse in the modulation sequence is wider than or equal to the required minimum current pulse width.

15. The display driver of claim 14, wherein the processor is configured to determine the switching sequence via repeating the stretching, splitting and allocating process for a predetermined number of iterations wherein the shortest current pulse in the resulting switching sequence is wider than or equal to the minimum current pulse width.

16. The display driver of claim 14, wherein the individual current reference unit comprises:

a constant current source for generating the reference current; and a current-scaling circuit for scaling the reference current with the amplitude-scaling factor to form the scaled reference current.

17. The display driver of claim 16, wherein the current source is implemented as a switched-capacitor current reference circuit.

18. The display driver of claim 17, wherein the processor is further configured to provide a clock signal to the current source.

19. The display driver of claim 16, wherein the current-scaling circuit is a variable-gain current mirror responsive to the amplitude-scaling factor determined by the processor.

20. The display driver of claim 16, wherein the current-scaling circuit scales up or down the received copy of reference current with the amplitude-scaling factor to form the scaled current.

* * * * *